United States Patent [19]

Notley

[11] Patent Number: 4,828,005

[45] Date of Patent: May 9, 1989

[54] SCREEN FOR PARTITIONING OPEN FLOOR AREAS

[75] Inventor: Alan R. Notley, London, United Kingdom

[73] Assignee: Asher Systems Furniture Limited, London, United Kingdom

[21] Appl. No.: 145,684

[22] Filed: Jan. 14, 1988

Related U.S. Application Data

[63] Continuation of Ser. No. 872,383, Jun. 5, 1986, abandoned.

[30] Foreign Application Priority Data

Jun. 11, 1985 [GB] United Kingdom ..... 8514700

[51] Int. Cl.[4] ..... A47G 5/00

[52] U.S. Cl. ..... 160/351; 160/135

[58] Field of Search ..... 160/135, 351; 52/221, 52/238.1, 239, 474, 483

[56] References Cited

U.S. PATENT DOCUMENTS

| | | | |
|---|---|---|---|
| 3,735,794 | 5/1973 | Lebowitz | 160/135 |
| 3,809,142 | 5/1974 | Bleeker | 160/135 |
| 3,871,435 | 3/1975 | Lopatka | 160/135 |
| 4,129,163 | 12/1978 | Johnson | 160/135 |
| 4,144,924 | 3/1979 | Vander Hoek | 160/135 X |
| 4,158,936 | 6/1979 | Fulton | 160/135 X |
| 4,232,724 | 11/1980 | Brown | 160/135 |
| 4,448,003 | 5/1984 | Hasbrouck | 160/351 X |
| 4,497,356 | 2/1985 | Luck et al. | 160/135 |
| 4,567,698 | 2/1986 | Morrison | 160/135 X |
| 4,571,906 | 2/1986 | Ashton | 160/351 X |

*Primary Examiner*—Robert W. Gibson, Jr.
*Assistant Examiner*—David M. Purol
*Attorney, Agent, or Firm*—Lowe, Price, LeBlanc, Becker & Shur

[57] ABSTRACT

A screen for use as a movable partition for dividing an open floor area comprises a frame to which screening material attached, the frame having upright side members interconnected by transverse members. Connected with one or both of the upright members and extending therealong is a stripform extrusion which receives a number of hinge tube sections which cooperate with similar hinge tube sections provided on a like stripform extrusion on a similar screen to afford substantially coaxial hinge tube sections alongside the extrusions of the two screens. In these sections a hinge pin is provided to form a hinge connection between the adjacent screens. The hinge pin may itself be formed by several cylindrical sections fitted together end-to-end and inserted in said coaxial hinge tube sections.

16 Claims, 7 Drawing Sheets

Figure 1:
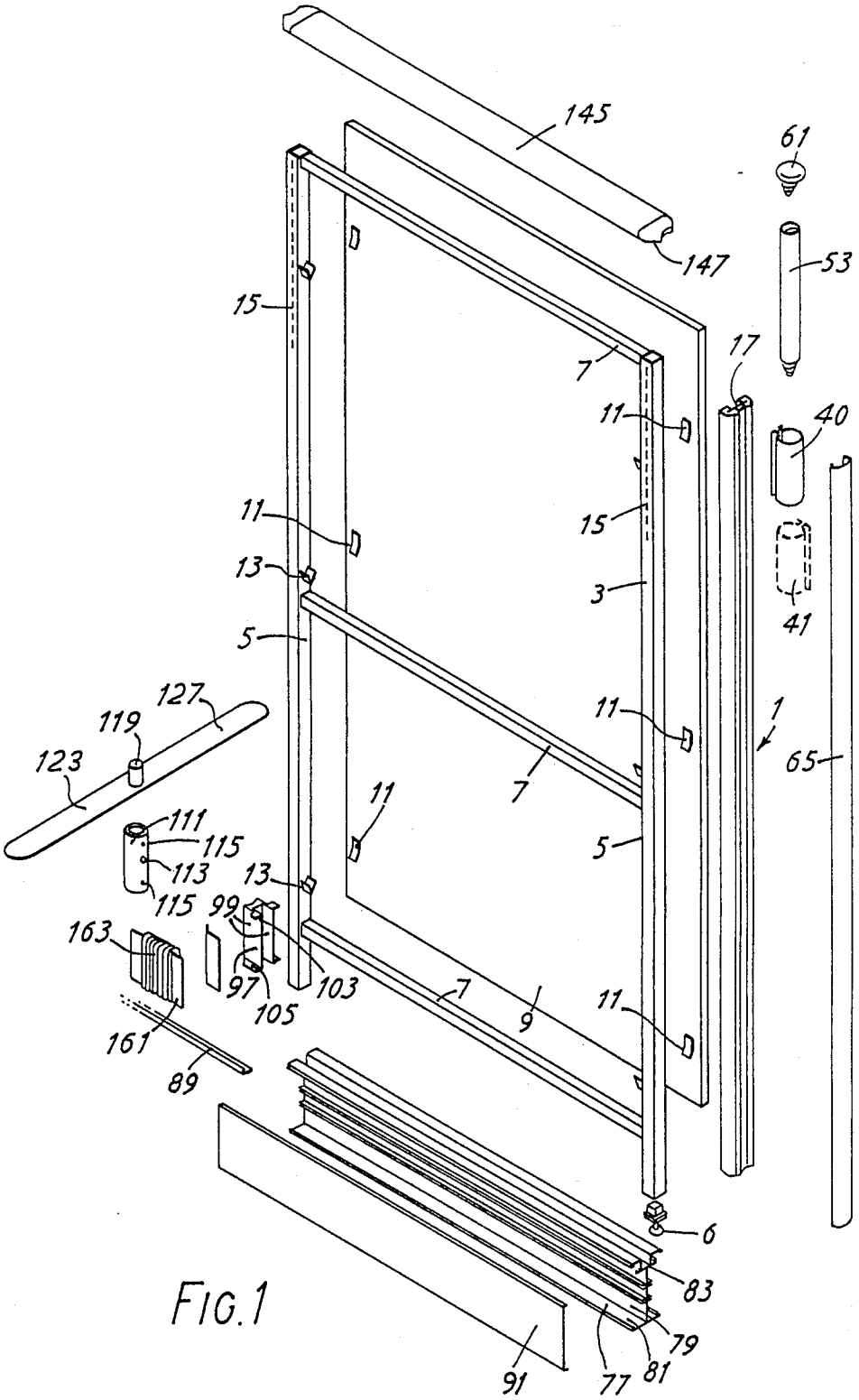

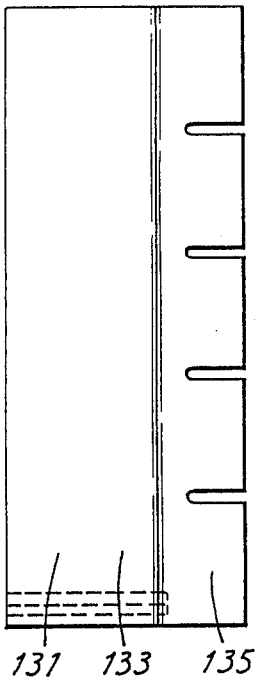
FIG. 12
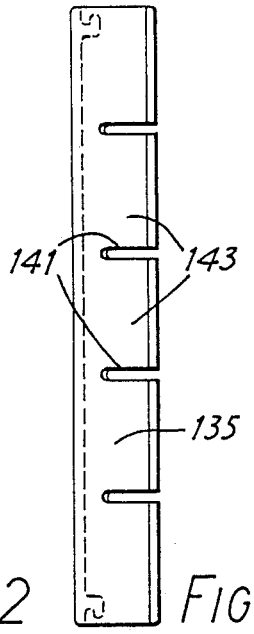
FIG. 13
FIG. 14
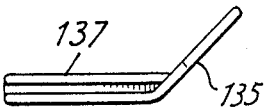
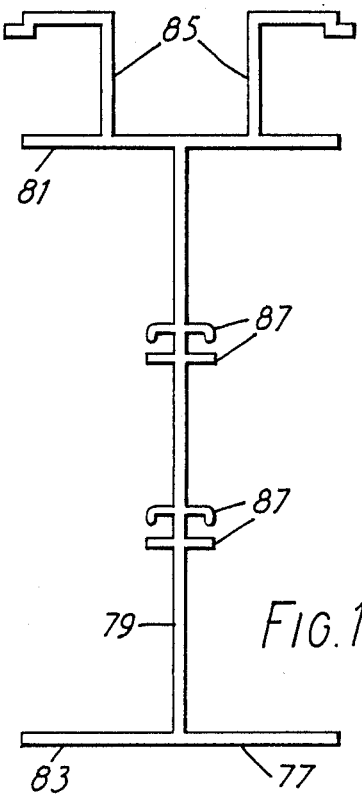
FIG. 15
FIG. 16
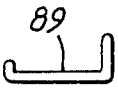
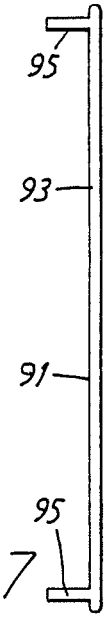
FIG. 17

SCREEN FOR PARTITIONING OPEN FLOOR AREAS

This application is a continuation of Application Ser. No. 872,383, filed June 5, 1986 now abandoned.

This invention relates to screens and, more particularly, screens such as are employed to provide movable partitions for dividing open floor areas in readily adjustable fashion. Screens of the kind referred to are finding increasing use in office environments as a means both of economically utilizing available space and of affording flexibility as regards the disposition of office areas so that, if required, the configuration of a set of offices employing screens of the kind referred to can be rapidly changed to suit changing criteria.

Screens of the kind referred to require to be connectible either in coplanar fashion or with any required angle between screens connected along adjacent upright edges. Also, it is important to be able to connect together at a common location upright side edges of three or more screens. Further, ready assembly of screens of the same and of different heights and ready interconnection thereof as well as ready separation of such screens and dismantling of individual screens are operations which should easily be performed on site with minimum use of tools. Often, assembly and dismantling is made very difficult where screens extend to nearly the full height of the room forming the site because of the need to insert into and extract from adjoining screens long hinge pins.

It is an object of the present invention to provide movable partitioning means for dividing an open floor area which satisfy the requirements mentioned.

The present invention consists in movable partitioning means for dividing an open floor area comprising two screens and a hinge pin on which said screens can be mounted each of said screens being formed by a frame having upright members and transverse member interconnecting said upright members, screening material attached to said frame, a strip-form extrusion connected alongside one of said upright members, and a plurality of hinge tube sections engageable with said strip-form extrusion and substantially each hinge tube section having a longitudinal axis parallel with said extrusion so as to be slidable lengthwise thereof, substantially each hinge tube section having end surfaces structured to enable adjacent like hinge tube sections to engage, at said end surfaces, in butting end to end coaxial relationship so that said hinge tube sections may be aligned coaxially in end to end transversely separable butting engagement to form a hinge tube between said screen frames, and said hinge pin being formed by plural separable cylindrical sections disposed coaxially and engageable within said hinge tube sections, said adjacent hinge tube sections being separable from each other by movement of one of said hinge tube sections in a direction perpendicular to the longitudinal axis with said butting end surfaces being slidable against each other during movement in said direction.

Preferably, the strip-form extrusion is formed with a retaining groove and the tube sections are formed with projections which complementarily fit and are retained within the groove.

Suitably, said projections include lateral extensions which fit in complementary manner within opposite sides of the groove.

Advantageously, the strip-form extrusion is formed alongside the groove thereof with at least one channel extending parallel with said groove for accommodating cables or the like.

Figure 2:
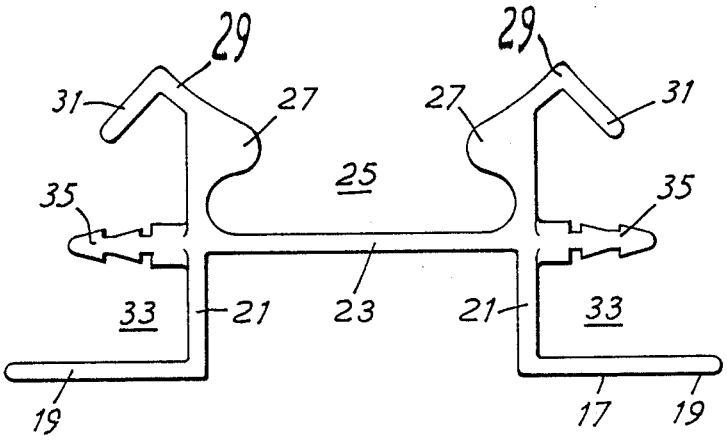
Figure 3:
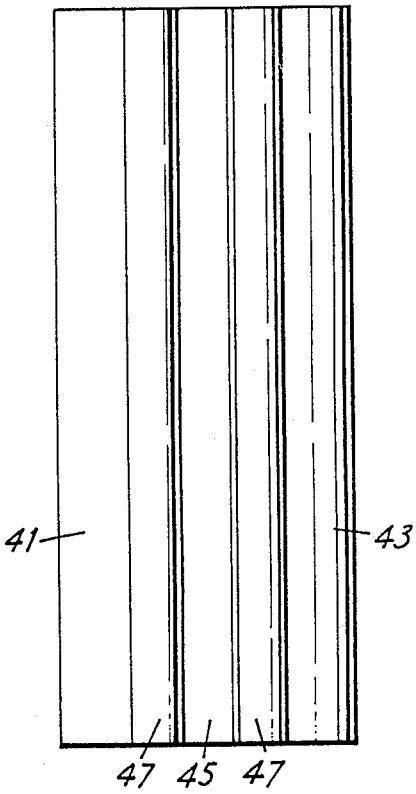
Figure 4:
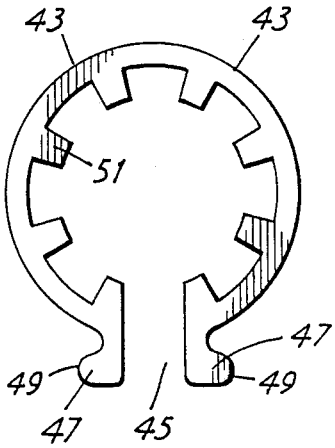
Figure 5:
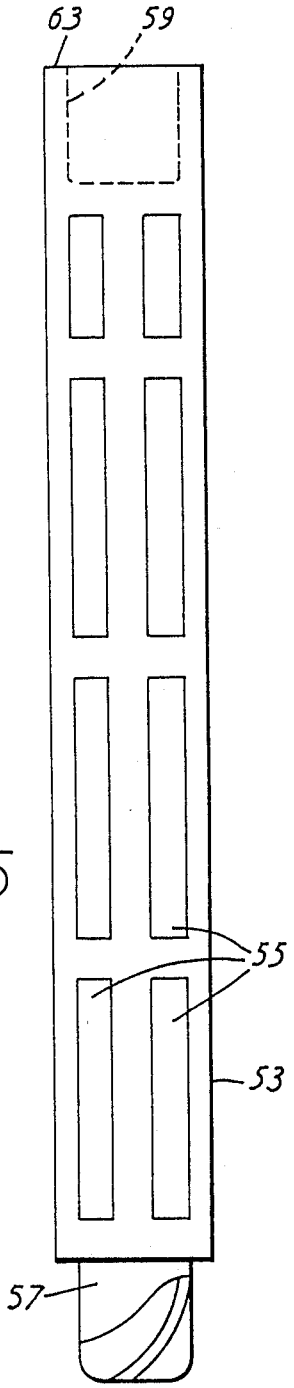
Figure 6:
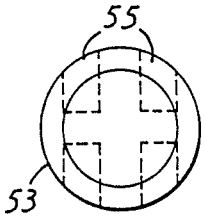
Figure 7:
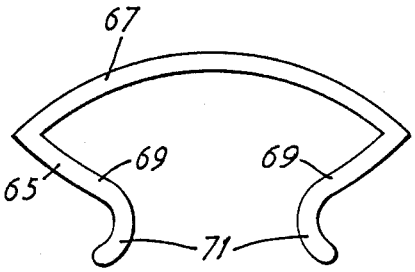
Figure 8:
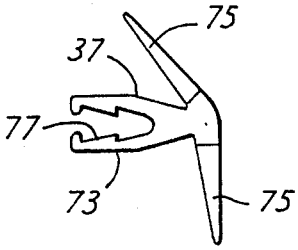
Figure 9:
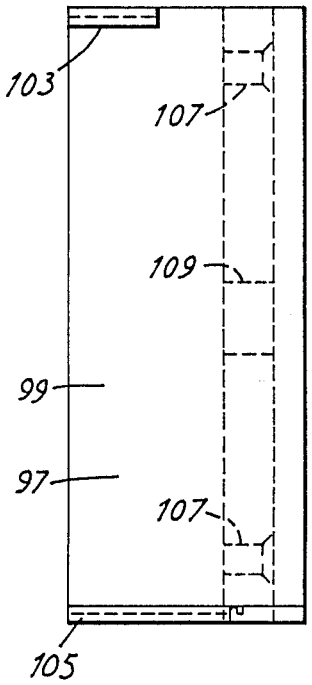
Figure 10:
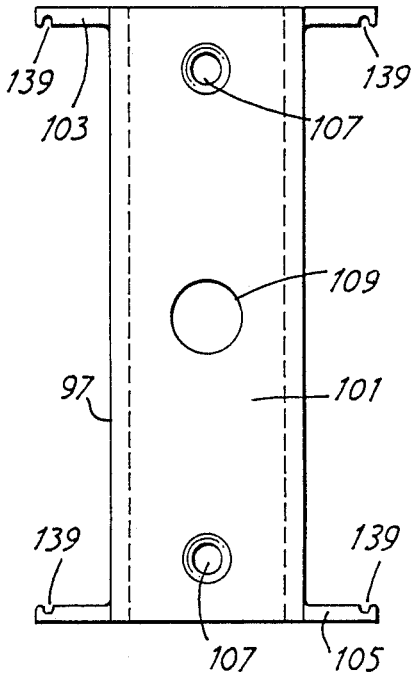
Figure 11:
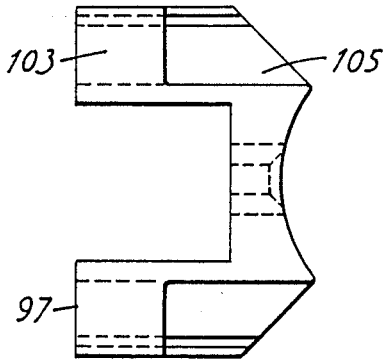
Figure 18:
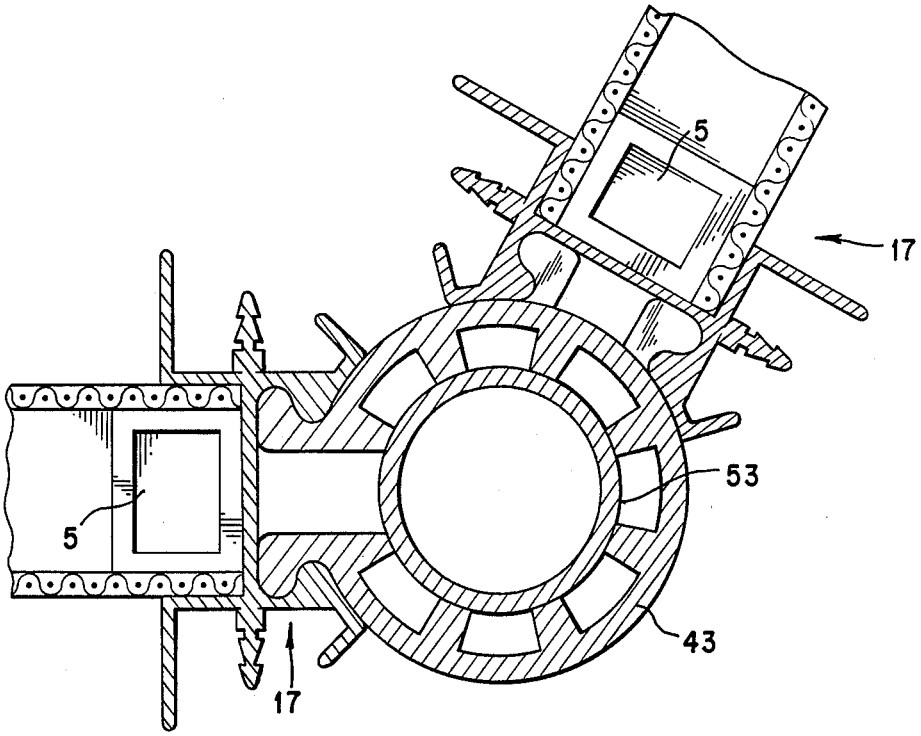

The invention will now be described, by way of example, with reference to the accompanying drawings, in which:

FIG. 1 is an exploded perspective view of a screen, according to the invention, for use as movable partitioning means for dividing an open floor area, and illustrating some optional features, FIG. 2 is a top plan view of a strip-form extrusion forming part of the screen of FIG. 1, FIGS. 3 and 4 are elevation and plan views of a hinge tube section employed with the screen to FIG. 1, FIGS. 5 and 6 are elevation and plan views of a hinge pin section employed with the hinge tube section of FIGS. 3 and 4, FIG. 7 is a plan view of a trim strip for use with the strip-form extrusion of FIG. 2, FIG. 8 is a plan view of a cover-strip for use with the strip-form extrusion of FIG. 2, FIGS. 9, 10 and 11 are side elevation, and elevation and plan views of an end cap for fitting to the screen of FIG. 1, FIGS. 12, 13 and 14 are side elevation, and elevation and plan views of a side cover for the end cap of FIGS. 12, 13 and 14, FIG. 15 is a cross-sectional view of a cable carrier provided on the screen of FIG. 1, FIG. 16 is an end elevation of a shelf used with the cable carrier of FIG. 15, FIG. 17 is an end elevation of a cover plate used with the cable carrier to FIG. 15, FIG. 18 is a sectional view of two screens connected together in accordance with the present invention.

Figure 18A:
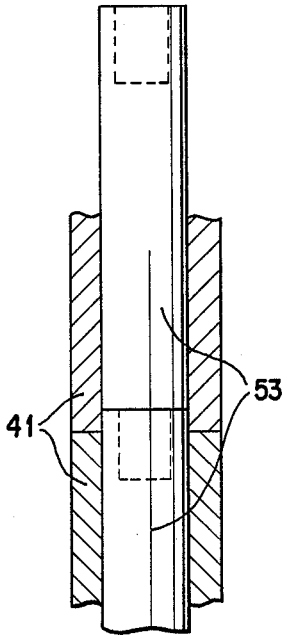

FIG. 18A is a sectional view of two hinged tube sections and adjacent hinge pin sections connected and mounted together in accordance with the present invention.

Referring first to FIGS. 1 to 8, a screen generally indicated by the reference numeral 1 comprises a frame having upright side members 5 provided at their lower ends with levelling screws 6 and interconnected by transverse members 7. Screening material in the form of a sound deadening panel 9 is attached to each side of the frame by means of clips 11 and 13 respectively provided on the panel and the frame. It will be appreciated that panels 9 are fitted on each side of the frame and when so fitted, the edges of the panels lie flush with the outer surfaces of the upright members 5, the top surface of the uppermost transverse member 7 and the bottom surface of the lowermost transverse member 7. Along the faces of the upright members 5 which are disposed in the forward and rear planes of the frame 3, are provided rows of slots 15 in which can be hung shelves, filing bins, storage cabinets and the like. Connected with each of the upright members 5 and extending therealong is a strip-form extrusion 17 which is shown in detail in FIG. 2. This comprises side flanges 19 from which extend at right angles walls 21 between which extends a further wall 23. The walls 21 extend beyond the wall 23 to define a groove 25. The parts of the walls 21 which define sides of the groove 25 are formed with facing enlargements 27 which enable, as hereinafter described, retention in the groove 25 of certain components. At their outer ends, the walls 21 have outwardly extending portions 29 which terminate in rearwardly and outwardly extending portions 31. The walls 21 each, together with the corresponding flange 19 and wall portions 29 and 31 form a channel 33 at each side of the extrusion 17. The wall 21 constitutes the base of the corresponding channel 33 and the wall 19 and wall portions 29 and 31, the side walls thereof. Each channel 33 is divided by retaining means 35 to which, as hereinafter described, is fitted a cover strip 37 (see FIG. 8). The strip 17 is mounted on the corresponding upright member 5 by means of screws (not shown) connecting the wall 23 to the upright member 5. When so mounted, the flanges 19 of the strip 17 project outwardly and engage and overlie completely upright edges of the panel 9.

For interconnecting similar panels 1, there are engaged within the groove 25 of the extrusion 17 a series of hinge tube sections 41 (see FIGS. 1, 3 and 4). Said sections comprise a generally cylindrical body 43 formed with a longitudinal slot 45 at opposite sides of which extend outwardly projections 47 formed with enlargements 49 on the sides thereof remote from the groove 45. The hinge tube section is formed internally with longitudinally extending ribs 51 and is a plastic injection moulding.

The sections 41 are inserted in the extrusion 17 within which the enlargements 49 are engaged in complementary manner respectively against the enlargements 27 of the groove side walls 21. It will be apparent, accordingly, that a continuous hinge tube can be assembled from hinge tube sections engaged in the strip-form extrusions 17 of a number of similar screens. With the design illustrated in the drawings, such a tube can be formed by hinge tube sections attached to the strip-form extrusions of up to four screens. The hinge tube assembled by positioning coaxially hinge tube sections from a number of screens is advantageously formed by aligning in sequence throughout the assembled hinge tube, tube sections 41 from the different screens to be connected. The screens themselves can be disposed at any desired angular spacing.

A hinge pin formed from hinge pin sections 53 (see FIGS. 1, 5 and 6) is engaged within the coaxially aligned hinge tube sections 41 to connect together the screens to which the hinge tube sections are attached. The hinge pin sections are twice the length of the hinge tube sections and are plastic injection mouldings. Each such section is of cylindrical form having a diameter slightly less than the internal diameter of the hinge tube sections between the ribs 51 and having slots 55 for easy release thereof from the moulding tools. Each hinge pin section is formed at one end with an externally threaded portion 57 of diameter less than the external diameter of the hinge pin section and at the other end with an internally threaded bore 59 within which the threaded portion 57 of a further hinge pin section can be engaged. The thread formed on the portions 57 and bores 59 are such that firm engagement between adjacent hinge pin sections is accomplished by a quarter turn of one section relative to an adjoining section. At the uppermost end of the hinge tube formed by the sections 53, is threadedly engaged a locking cap 61 the diameter of which is such that it engages on an uppermost surface 63 of the topmost hinge tube section 41 thus axially locating the hinge pin formed by the sections 53. It will be apparent that because of the relatively short length of the hinge tube sections 41 and hinge pin sections 53, the hinge tube can be assembled and the hinge pin fitted within the hinge tube notwithstanding very limited headroom between the top of the screen and the ceiling of the room in which the connected screens are assembled. Also because of the section form of the hinge tube and hinge pin, the arrangement is readily employed to hinge together screens of different heights.

At the edges of the screens which are not to be connected to adjoining screens, there is engaged within the groove 25 of the relevant strip-form extrusion, a trim strip 65 (see FIGS. 1 and 7) which comprises an outwardly bowed outer wall 67 terminating at opposite ends thereof in radially inwardly directed walls 69 which, remotely from the wall 67 are formed with short return bends 71. The cover strip is formed as a plastics extrusion and is deformable to allow the return bends 71 to engage in the groove 25 of the strip-form extrusion 17 behind the enlargements 27 of the side walls 21 of the groove.

The space formed between the walls 67 and 69 of the trim-strip provides a cable-way, if required, for the passage of cables along the vertical side of the strip-form extrusion.

Reverting the FIG. 2, the channels 33 extending alongside the groove 25 form the principal channels for accommodating cabling in the strip-form extrusion. Each channel 33 is sub-divided into two channels by the retaining means 35 to which the cover strip 37 is fitted. The cover strip comprises a plastics extrusion having a central rib 73 and lateral flanges 75 each of which tapers outwardly from the boss. The rib 73 is formed with an internal profile 77 complementary with the external profile of the retaining means 35 so that the cover strip 37 is a push fit on the retaining means. The strip 37 is formed as a dual density plastics extrusion, the rib 73 being of greater density than the flanges 75. The lower density of the flanges 75 and their outwardly tapering form imparts flexibility thereto so that in the position where the strip 37 is mounted on the retaining means 35, the flanges 75 which, respectively cover the spaces between the retaining means 35 and the wall 19 and wall portion 31, can be deflected inwards to enable cables extending alongside the channel 33 to be presented into the channel by resilient deflection of the flanges 75. These cables can be brought out at any desired height vertically. Also, cables can be extracted from the channels 33 by deflecting the flanges 75 and drawing the cables from the channel 33.

Attached to the lowermost transverse member 7 of the frame is a cable carrier 77 (see FIGS. 1 and 15). This comprises an aluminium extrusion of I-shaped cross section having an upright web 79 and upper and lower flanges 81 and 83 extending on opposite sides of the web 79. The upper flange 81 carries upstanding members 85 within which the lowermost transverse member 7 of the frame is engaged and to which the member is secured.

Intermediate the height of the web 79 are pairs of rails 87 in which are engageable shelves of the form of shelf 89 (see FIG. 16). The shelf 89 hooks into the rail and provides a partition of the compartment defined by the web 79 and the upper and lower flanges 81 and 83 to one side of the web. Cables can be run in each of the compartments referred to and can be separated as desired within those compartments by the shelves 89. The compartments themselves are closed by clip-on covers 91 each comprising a side wall 93 and short end walls 95 which engage the inner facing sides of the flanges 81 and 83.

At the lower ends of the upright members 5 of the frame are mounted end caps 97 (see FIGS. 1 and 9 to 11). These are of channel shape having side walls 99 joined by a bowed front wall 101. The side walls 99 engage opposite sides of the upright side member 5 of the frame and are formed at their top and bottom edges with flanges 103 and 105. The end caps are screwed to the upright members 5 by screws (not shown) which extend into countersunk holes 107 in the bowed wall 101. A central hole 109 is provided in the wall 101 by means of which a cylindrical foot moulding 111 is attached to the upright member 5. To this end, a tapped hole is provided in the upright member 5 which is coaxial with the hole 109 and diametrically opposite holes 113 are formed in the foot moulding, one only of these holes being visible in the view of the foot moulding shown in FIG. 1. A screw extends through the holes 113 of the moulding 111 and through the hole 109 into the tapped hole of the upright frame member 5. Recesses 115 in the foot moulding above and below the hole 113 and aligned with the holes 107 ensure that if screws engaged in the holes 111 are slightly proud of the surface of the wall 101, which surface is of complementary curvature to that of the foot moulding, the foot moulding can nevertheless be disposed with its axis vertical. The foot moulding itself can be engaged by upstanding cylindrical projections 119 provided on a flat foot member 123 which has a foot piece 127 which extends on opposite sides of the screen.

Reverting to the end cap 97, the space defined at opposite sides thereof by the flanges 103 and 105 together with the side wall 99 affords a channel for the passage of cable to the cable carrier or from the cable carrier either to an adjoining screen or to some other point or to the channels at the sides of the strip-form extrusion 17. This space is closed by a side plate 131 (see FIGS. 12, 13 and 14) which includes a rear part 133 and a forward part 135 which is inclined with respect to the rear part 133 at an angle of 45°. At the top and bottom of the part 133 and formed rails 137 which each engage in slots 139 in the flanges 103 and 105 of the cap 97. The side plate 133 is formed from plastics material and the part 135 thereof is provided with slots 141, the parts 143 between said slots forming resilient flaps through which access can be obtained to cables within the spaces closed by the side plate 131.

The trim of the screen is completed by a top cap 145 which overlies the uppermost surface of the top transverse member 7 of the frame and the top edge surfaces of the panels 9. Also, the top cap 145 has end pieces 147 which overlie the top of the strip-form extrusion 17.

When screens are hinged together and mutually angled instead of plates 131, there are connected to the end caps 97 plates 161 which include a longitudinally flexible folded part 163 which enables the plate to accommodate itself to the spacing of the flanges of the end caps 97 which depends on the angle between the screens to which they are attached.

I claim:

1. Movable partitioning arrangement for dividing an open floor area comprising at least two screens and a hinge pin on which said screens can be mounted, each of said screens being formed by a frame having upright members and transverse member interconnecting said upright members, screening material attached to said frame, a strip-form extrusion connected to extend along one of said upright members, and a plurality of coaxial hinge tube sections each slidably engaged within said strip form extrusion, said hinge tube sections defining at each end thereof a generally planar surface and being carried on each of said screens and being interleavably and coaxially disposed in end to end, abutting, transversely separable relationship, to form a hinge tube between said screen frames, and said hinge pin being formed by a plurality of pin sections disposed coaxially with each other and engaged with adjacent pin sections within said hinge tube sections, said adjacent hinge tube sections thereby being separable from each other by planar movement of one of said hinge tube sections in a transverse direction generally perpendicular to the longitudinal axis with said butting end surfaces being slidable against each other during said planar movement in said transverse direction.

2. Movable partitioning arrangement as claimed in claim 1, wherein said strip-form extrusion is formed with a longitudinally extending retaining groove and each tube section is formed with projections which are engageable in complementary manner within said groove for retention therein.

3. Movable partitioning arrangement as claimed in claim 2, wherein lateral extensions are respectively formed on said projections to fit in complementary manner within opposite sides of said groove.

4. Movable partitioning arrangement claimed in claim 3, wherein the groove on the strip-form extrusion faces away from the frame of the associated screen in a direction parallel with and close to a plane containing the frame.

5. Movable partitioning arrangement as claimed in claim 2, wherein at least one channel for accommodating cables is formed in said extrusion and extends parallel with the groove thereof.

6. Movable partitioning arrangement as claimed in claim 5, wherein two channels, each serving to accommodate cables are provided in said strip-form extrusion on respective opposite sides of and extending alongside said groove.

7. Movable partitioning arrangement as claimed in claim 2, wherein said strip-form extrusion is formed with a channel which extends alongside said groove, said channel having a base, and side walls extending from said base and retaining means projecting from the base between said side walls, and a cover strip provided for said channel, said cover strip having a central part which is complementarily engageable with said retaining means and lateral flanges which respectively cover the channel between one of the side walls and the retaining means.

8. Movable partitioning arrangement as claimed in claim 7, wherein the flanges of the cover strip are flexible to enable insertion into said channel of cables by pressing the cables against one of the flanges so to deflect that flange as to allow passage of the cables behind the flange.

9. Movable partitioning arrangement as claimed in claim 8, wherein the cover strip is formed from dual density plastics material the central part of the strip being of a higher density than the lateral flanges thereof thereby to impart flexibility to the flanges.

10. Movable partitioning arrangement as claimed in claim 2, wherein a trim-strip is provided which is formed along opposite edges thereof with means engageable in complementary manner in opposite sides of the retaining groove.

11. Movable partitioning arrangement as claimed in claim 1, further including a cable carrier which extends between the upright members of each screen and is of I-shaped section and is secured below a lowermost transverse member of the frame and said cable carrier comprises an upright web and transverse upper and lower flanges which together with said web form channels respectively facing in opposite directions away from the plane of the screen, there being provided for each of said channels a cover plate which clips and is retained on free edges of said upper and lower flanges.

12. Movable partitioning arrangement as claimed in claim 11, wherein a shelf is mounted on at least one side of the web of the cable carrier which provides upper and lower separated regions in the carrier in which different cable runs are disposable.

13. Movable partitioning arrangement as claimed in claim 1, further including an end cap mounted at the foot of each upright side member of the frame of each screen and is of channel shape having side walls which flank opposite sides of the corresponding upright member and an inwardly bowed wall which connects said side walls to serve as a support for a complementary cylindrical foot moulding within which a screen foot is engageable.

14. Movable partitioning arrangement as claimed in claim 13, wherein said screen foot comprises a flat foot member with an upstanding cylindrical projection which is closely engageable within the foot moulding.

15. Movable partitioning arrangement as claimed in claim 13, wherein the end caps are formed with upper and lower outwardly projecting flanges and a longitudinally flexible link is provided to connect said flanges of end caps of adjacent mutually hinged screens to cover cabling extending between said end caps.

16. Movable partitioning arrangement for dividing an open floor area comprising at least two screens and a hinge pin on which said screens can be mounted, each of said screens being formed by a frame having upright members and transverse member interconnecting said upright members, screening material attached to said frame, a strip-form extrusion connected to extend along one of said upright members, and a plurality of coaxial hinge tube sections each slidably engaged within said strip form extrusion, carried on each of said screens and being interleavably and coaxially disposed in end to end, abutting, transversely separable relationship, to form a hinge tube between said screen frames, and said hinge pin being formed by a plurality of substantially identical pin sections disposed coaxially with each other and engaged with adjacent pin sections within said hinge tube sections, said adjacent hinge tube sections thereby being separable from each other by planar movement of one of said hinge tube sections in a transverse direction generally perpendicular to the longitudinal axis with said butting end surfaces being slidable against each other during said planar movement in said transverse direction.

* * * * *